US007128607B2

(12) United States Patent
Li

(10) Patent No.: US 7,128,607 B2
(45) Date of Patent: Oct. 31, 2006

(54) SOCKET CONNECTOR WITH RELIABLE SHIELDING MEMBER

(75) Inventor: Chao-Chang Li, Tu-Cheng (TW)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 0 days.

(21) Appl. No.: 11/219,057

(22) Filed: Sep. 2, 2005

(65) Prior Publication Data

US 2006/0063399 A1 Mar. 23, 2006

(30) Foreign Application Priority Data

Sep. 23, 2004 (CN) ..... 2004 2 0079820

(51) Int. Cl.
*H01R 13/648* (2006.01)

(52) U.S. Cl. ..... 439/607

(58) Field of Classification Search ..... 439/607, 439/608, 331, 330, 332
See application file for complete search history.

(56) References Cited

U.S. PATENT DOCUMENTS 4,192,585 A * 3/1980 Henkelmann et al. ..... 353/101
4,745,456 A * 5/1988 Clemens ..... 257/717
5,364,278 A * 11/1994 Laub ..... 439/69
2005/0048829 A1 * 3/2005 Nishio et al. ..... 439/331

* cited by examiner

*Primary Examiner*—Phuong Dinh
(74) *Attorney, Agent, or Firm*—Wei Te Chung

(57) ABSTRACT

A socket connector adapted for receiving an electronic element therein includes an insulative housing defining an upper opening for receiving an electronic element therein, a plurality of terminals received in the housing, and a first and a second shell member for enclosing the housing. Each terminal has a retaining portion secured in the housing and a contact portion extending into the upper opening of the housing for electrically engaging with the electronic element. The first shell member is assembled to the housing from a lower-to-upper direction for surrounding substantial lateral side of the opening of the housing. The first shell member has at least one retaining member extending upwardly for engaging with the insulative housing. The second shell member is assembled to the housing from an upper-to-lower direction for surrounding a substantial upper side of the opening of the housing.

2 Claims, 6 Drawing Sheets

SOCKET CONNECTOR WITH RELIABLE SHIELDING MEMBER

BACKGROUND OF THE INVENTION

1. Field of the Invention

The present invention relates to electrical connectors, and more particularly to a socket connector adapted for receiving an electronic element therein and mountable to a Printed Circuit Board (PCB).

2. Description of the Prior Art

Socket connectors typically used for connecting an electronic element to a printed circuit board. U.S. Patent Application Publication No. 2003/0218873 (Eromaki connector) discloses a conventional socket connector for fastening a component in an electronic device. The fastening structure includes a frame encasing the component and having one side substantially open to fit the component therein. As clearly shown in FIG. 3 and described in Paragraph [0030] of the Eromaki prior art, the disclosed frame has a bottom and a plurality of flexible strips close to each other. Each strip has the form of a clasp-like tongue. Some of the strips form hole like openings (Paragraph [0038]) for engaging with bulges on the component for retaining the component therein.

However, the fastening structure on the strip of the Eromaki connector is not firm because the flexible strip is easy to deflect, and thus the component is likely to drop out of the connector due to outer shock, or the like. Moreover, the Eromaki connector can not achieve desired Electro-Magnet Interference suppression because there are a plurality of slots between adjacent strips.

Hence, an improved socket connector is desired to overcome the above problems.

BRIEF SUMMARY OF THE INVENTION

It is an object of the present invention to provide a socket connector adapted for securely receiving an electronic element therein, the socket connector is well shielded for suppressing Electro-Magnetic Interference.

In order to obtain the objective above, a socket connector according to a preferred embodiment of the present invention includes an insulative housing defining an upper cavity for receiving an electronic element therein, a plurality of terminals received in the housing, and a first and a second shell member for enclosing the housing. Each terminal has a retaining portion secured in the housing and a contact portion extending into the upper cavity of the housing for electrically engaging with the electronic element. The first shell member is assembled to the housing from a lower-to-upper direction for surrounding a substantial lateral side of the cavity of the housing. The first shell member has at least one retaining member extending upwardly for engaging with the insulative housing. The second shell member is assembled to the housing from an upper-to-lower direction for surrounding a substantial upper side of the cavity of the housing.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims.

The invention, together with its objects and the advantages thereof, may be best understood by reference to the following description taken in conjunction with the accompanying drawings, in which like reference numerals identify like elements in the figures and in which.

DETAILED DESCRIPTION OF THE INVENTION

Figure 1:
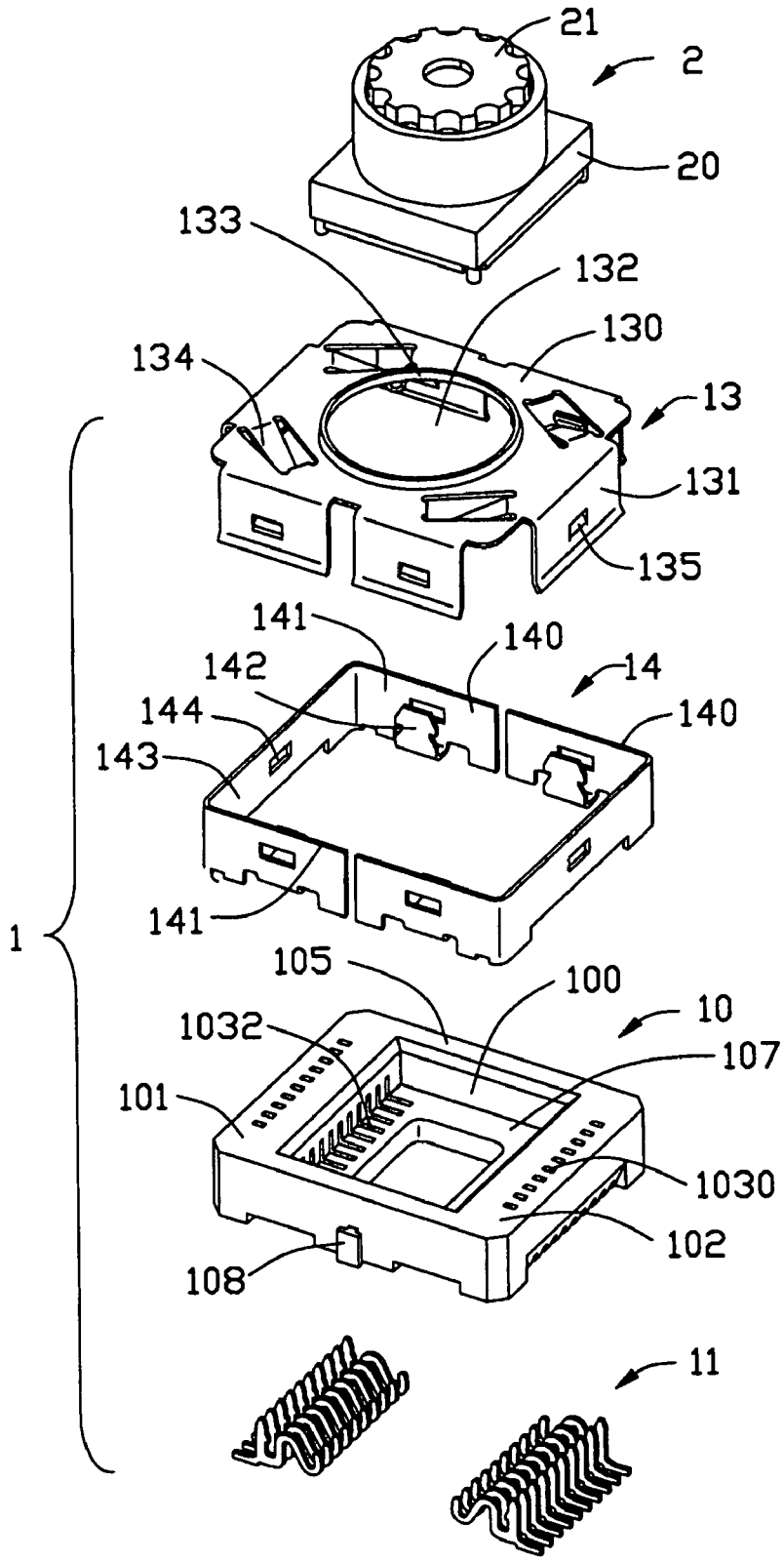
FIG. 1 is an exploded view of a socket connector according to an embodiment of the present invention, together with an electronic element to be mounted in the socket connector.
Figure 2:
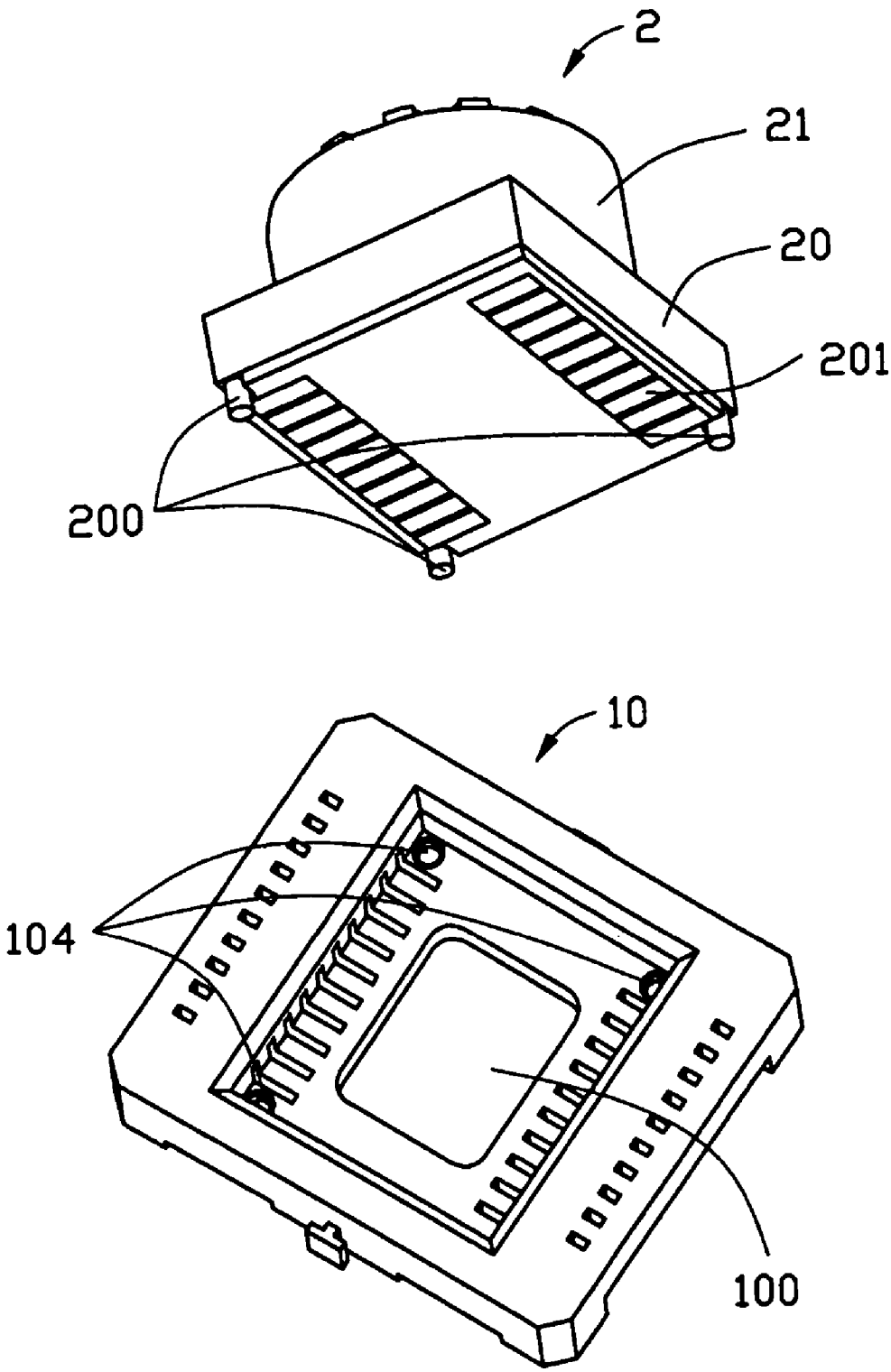
FIG. 2 is a perspective view of the socket connector and the electronic element, a peripheral shell and a top cover of the socket connector is removed for better illustration.

In the following detailed description, for purposes of explanation, numerous specific details are set forth in order to provide a thorough understanding of the present invention. It will be apparent, however, that the present invention may be practiced without these specific details. In other instances, well-known structures and devices are schematically shown in order to simplify the drawing.

A socket connector according to the present invention is applicable to the electronic apparatuses such as the digital cameras, PDAs (Personal digital Assistances), PCs (Personal computers), mobile telephones or the like. In the preferred embodiments illustrated in FIGS. 1–6, the socket connector 1 is used in a mobile handset (not shown) for connecting a camera module 2 to an internal PCB (not shown).

Referring to FIG. 1, the socket connector 1 includes a rectangular housing 10 for receiving the camera module 2, a plurality of contacts 11 received in the housing 10, a periphery shell 14 surrounding the housing 10, and a top cover 13 displaced over the housing 10 and retaining the camera module 2 in the housing 10.

Referring to FIGS. 1, 3, 5, and 6, the housing 10 is molded from insulative material and includes a pair of side walls 105, a front wall 101, a rear wall 102, a bottom wall 107, and a squared top cavity 100 in the walls for receiving the camera module 2 therein. Two rows of L-shaped receiving passageways 103 are respectively defined along the front and the rear walls 101, 102. Each receiving passageway 103 includes a channel 1031 in a lower portion of the front (or rear) wall 101 (102) and a slit 1032 extending through the bottom wall 107 and communicating with a corresponding channel 1031. Two rows of through holes 1030 are respectively defined in the front wall 101 and the rear wall 102 adjacent to the cavities 1031 and extending through upper and lower surfaces of the front wall/rear wall 101/102. a T-shaped protrusion 108 which has a larger outer dimension and a smaller inner dimension is formed on a substantially middle portion of an outer surface of each side wall 105. A plurality of retaining recesses 106 are defined in a bottom portion of the bottom wall 107. Three locating channels 104 are respectively distributed in three corners of the bottom wall.

Figure 3:
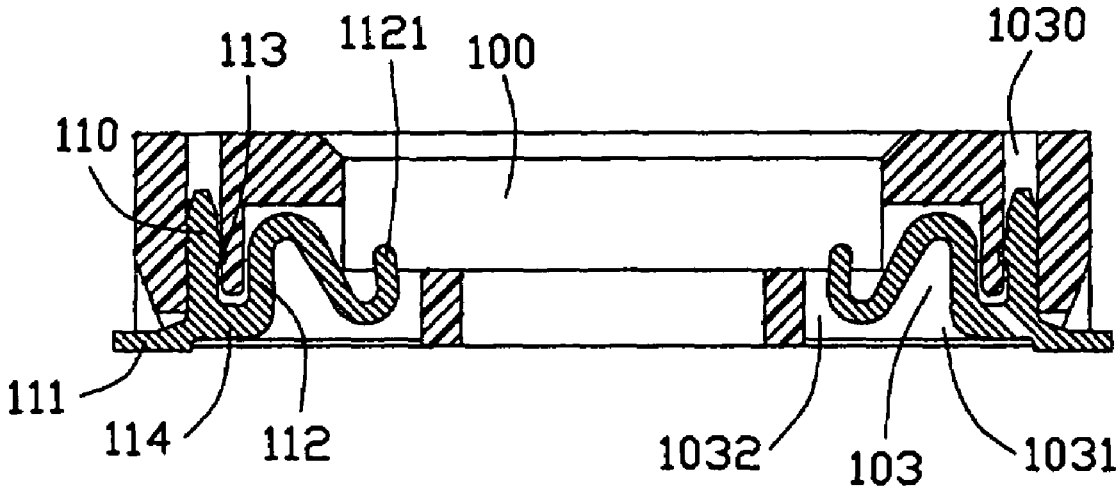
FIG. 3 is a cross-sectional view of the socket connector without the peripheral shell and the top cover.
Figure 4:
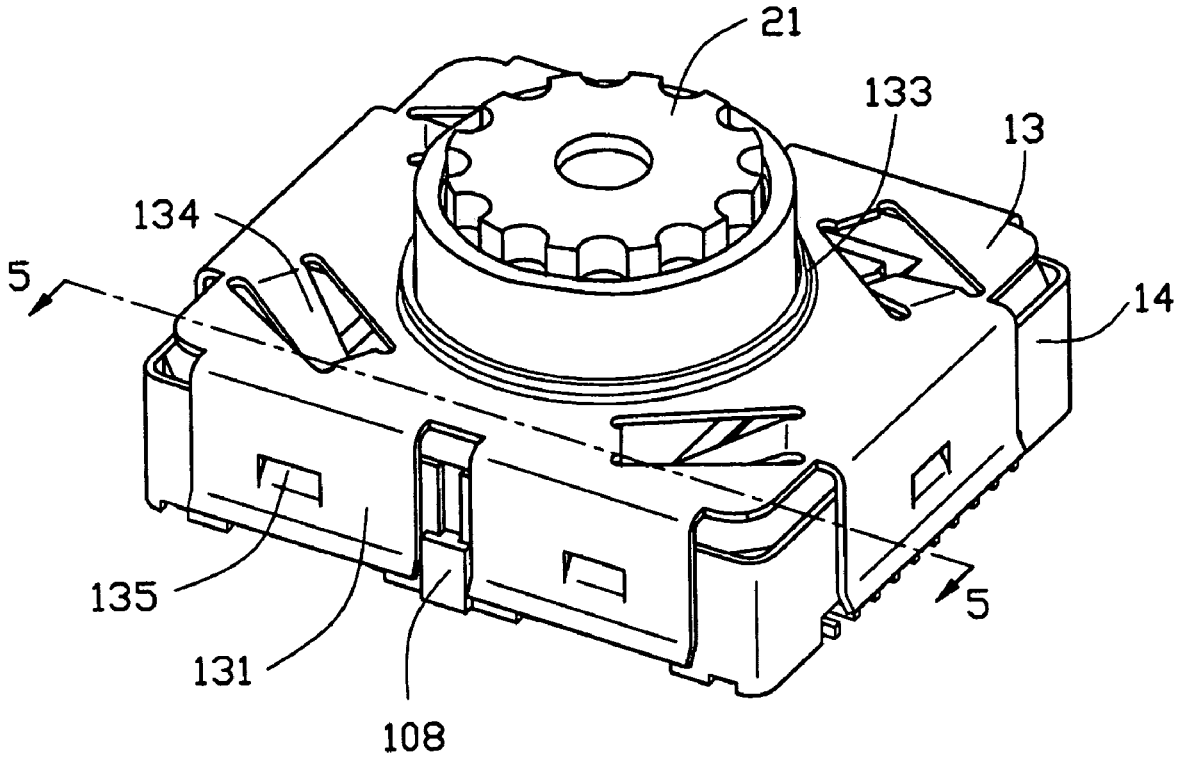
FIG. 4 is a perspective view of the socket connector.
Figure 5:
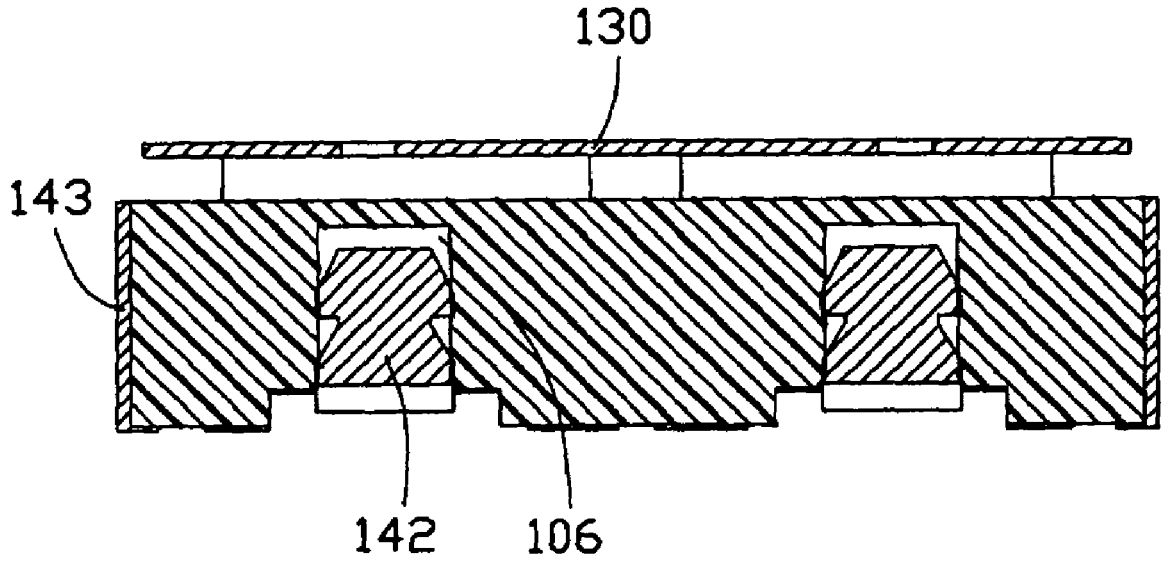
FIG. 5 is cross-sectional view taken along line 5—5 of FIG. 4.
Figure 6:
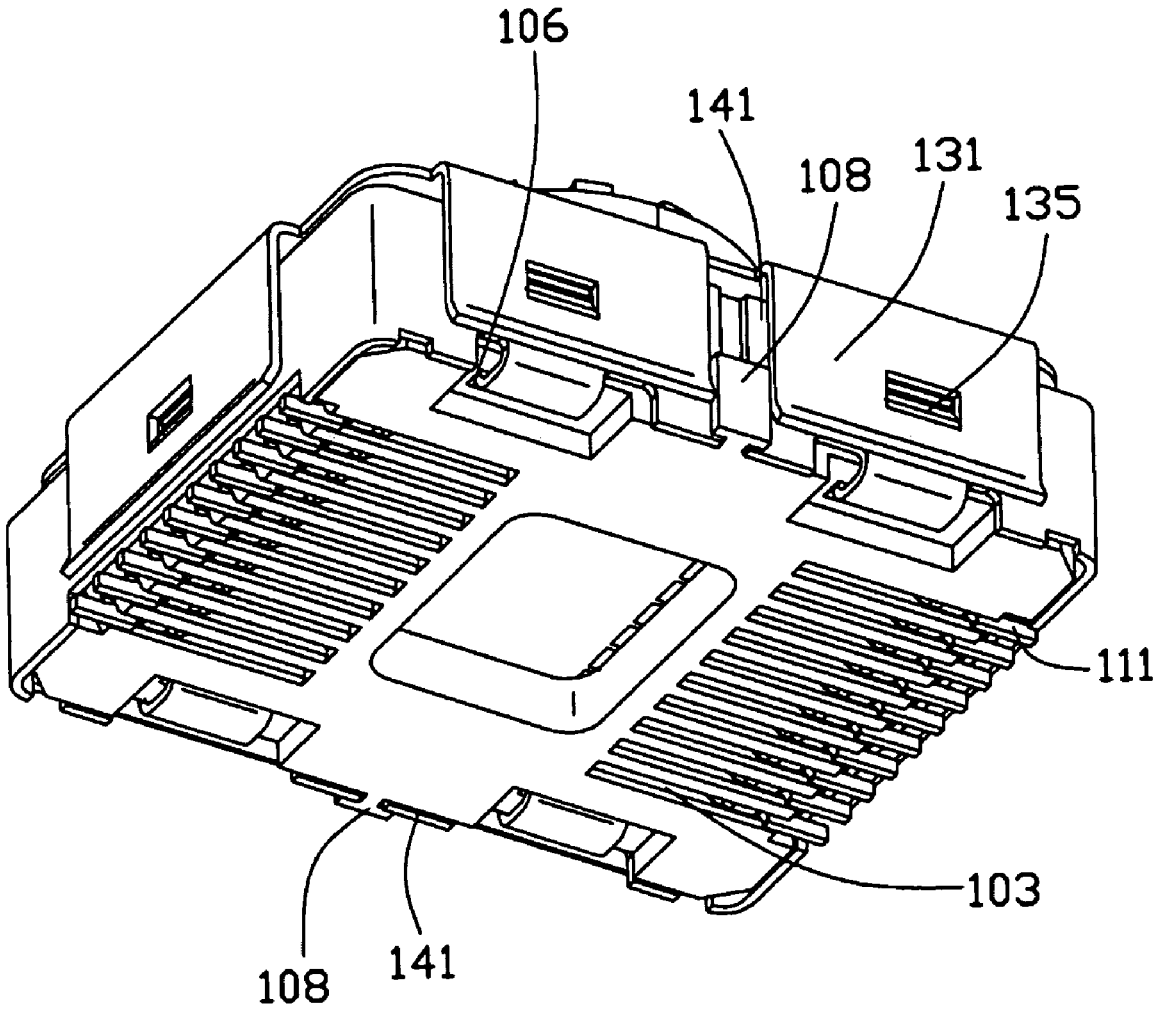
FIG. 6 is a perspective view of the socket connector from a bottom aspect.

Still referring to FIGS. 1 and 3, each contact 11 includes an vertical retaining portion 110, a solder tail portion 111 extending laterally from a lower end of the retaining portion 110, an S-shaped spring arm 112 extending laterally opposite to the solder tail portion 111, and a connecting portion 114 connecting the retaining portion 110 with the spring arm 112. The spring arm 112 has a free contact end 1121 movable in a substantial upper to lower direction. At least one barb 113 is formed on the vertical retaining portion 110.

The peripheral shell 14 is composed of two pieces of U-shaped metal member 140 with a height substantially equal to the height of the housing 10. The two U-shaped metal members are symmetrical about a longitudinal center line. Each U-shaped metal member 140 includes a longitudinal beam 143, a pair of side arms 141 both extending forwardly (rearwardly) from opposite ends of the beam 143. A plurality of cutouts 144 are defined in the beams 143 and the side arms 141. Each side arm 141 includes a retaining member 142 extending inwardly and upwardly from a lower edge thereof. In the preferred embodiment, the retaining member is an L-shaped retaining tab.

The top cover 13 includes a top plate 130 and a plurality of securing pieces 131 depending downwardly from the top plate 130. The top plate 130 defines a circular opening 132 in a middle portion thereof, a neck portion 133 extending upwardly and outwardly around the opening 132, and a plurality of stamped tabs 134 protruding downwardly. Each retaining piece 131 defines at least one stamped bulge 135 extending inwardly.

The camera module includes a column lens portion 21 and a lower base portion 20. A plurality of conductive pads 201 are formed on a lower surface of the base 20 in two rows. Three locating pegs 200 extending downwardly from three corner portion of a bottom surface of the base portion 20 correspond to the locating channels 104 of the housing 10.

In assembly, referring to FIGS. 3–6, the contacts 11 are assembled to the housing 10 from a bottom surface of the housing 10. The spring arm 112 is received in the L-shaped receiving passageway 103; the free contact end 1121 extending into the slits 1032 and extending upwardly out of the bottom wall 107; the solder tail portions 111 extending outwardly out of the lateral sides of the housing 10 to be soldered to the PCB; and the vertical retaining portions 110 are retained in the through holes 1030 with the barbs 113 interferentially engaging with the housing 10, and thus securing the contacts 11 in the housing 10.

The peripheral shell 14 is attached to the housing 10 from the bottom surface of the housing 10. The retaining tabs 142 are pressed into the retaining recesses 106 of the housing 10 and interferentially engage with the housing 10. Opposite ends of the side arms 143 engages with narrower inner portion and stopped by the broader outer portion of the T-shaped protrusion 108. The beams 143 and the side arms 141 surround outer peripheral of the housing 10.

The camera module 2 is disposed in the cavity 100 of the housing 10. The three locating pegs 200 engages with three the locating channels 104, therefore it is easy to find a correct direction to displace the camera module 2 in the housing 10. The column lens portion 21 extends through the circular opening 132 and the neck portion 133. Because the neck portion 133 extends upwardly and outwardly, whereby the camera module is protected from scraped by an edge top cover 13. The contact tabs 201 of the base portion 20 press against the free contact ends 1121 of the contacts 11 to move downwardly, and further the base portion 20 of the camera module 2 are stopped and supported by the bottom wall 107 of the housing 10.

The top cover 13 is displaced over the housing 10 from an upper-to-lower direction. The column lens portion 21 of the camera module extends out of the circular opening 132; the tabs 131 abut against outer surfaces of the peripheral shell 14 with the tabs 135 engaging with the cutouts 144; the tabs 134 abut against an upper surface of the base portion 20, whereby a secured and well electromagnetic suppressed camera connector module is obtained.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A socket connector adapted for receiving an electronic element therein, comprising:

an insulative housing defining an upper cavity for receiving an electronic element therein;

a plurality of terminals received in the insulative housing, each terminal having a retaining portion secured in the housing and a contact portion extending into the cavity of the housing for electrically engaging with the electronic element;

a first shell member assembled to the housing from a lower-to-upper direction for surrounding a substantial lateral side of the cavity of the housing, the first shell member having at least one retaining member extending upwardly for being secured to the insulative housing; and a second shell member assembled to the housing from an upper-to-lower direction for surrounding a substantial upper side of the cavity of the housing, the second shell member being locked with the first shell member wherein the second shell has a top plate and at least a pair of retaining pieces extending downwardly from the top plate, wherein the retaining pieces of the second shell has a plurality of inwardly bulges, and wherein the first shell member defines a plurality of cutouts engaging with the bulges, wherein the first shell member includes two U-shaped metal member being symmetrical about a longitudinal line, wherein a T-shaped protrusion is formed on an outer surface of the housing, the T-shaped protrusion has a outer portion having a larger dimension and an inner portion having a smaller dimension, and each metal member has an end locked at said inner portion of the T-shaped portion and prevented from getting out by the outer portion, the housing has a rectangular bottom wall with four corner portions, and the bottom wall defines three locating channels in respective three of the corner portions, wherein the second shell member has a top plate, and the top plate defines a circular opening and a neck portion extending upwardly and outwardly from a circular edge of the circular portion.

2. An electronic connector assembly comprising:

an electronic element having a substantially squared base portion and a column lens portion on the squared base portion, the base portion having a plurality of conductive pads; and a socket connector having:

an insulative housing defining an upper cavity dimensioned to receive the base portion of the electronic element;

a plurality of terminals received in the insulative housing, each terminal having a retaining portion secured in the housing and a contact portion extending into the cavity of the housing for electrically engaging with the contact pads of the electronic element;

a first shell member being assembled to the housing and surrounding a substantial lateral side of the cavity of the housing, and a second shell member being assembled to the housing and covering a substantially upper side of the cavity of the housing after the electronic element being disposed in the cavity of the housing, the second shell member has a circular opening, and the column lens portion of the electronic element extending through the circular opening of the second shell member, wherein the second shell member has a top plate, and the top plate defines a circular opening and a neck portion extending upwardly and outwardly from a circular edge of the circular portion, wherein the housing has a rectangular bottom wall with four corner portions, the bottom wall defines three locating channels in respective three of the corner portions, and the base portion of the electronic element forms three locating pegs respectively engaging with the locating channels.

* * * * *